United States Patent [19]

Mailloux et al.

[11] 4,083,632

[45] Apr. 11, 1978

[54] MULTI-FREQUENCY SCREEN

[75] Inventors: Louis D. Mailloux, Fairport; James E. Bollman, Williamson, both of N.Y.

[73] Assignee: Xerox Corporation, Stamford, Conn.

[21] Appl. No.: 673,318

[22] Filed: Apr. 5, 1976

[51] Int. Cl.[2] ..... G03G 15/00

[52] U.S. Cl. ..... 355/3 R; 96/116; 354/4

[58] Field of Search ..... 96/45, 116, 117, 118; 355/3 R, 11, 4, 71

[56] References Cited

U.S. PATENT DOCUMENTS

| | | | |
|---|---|---|---|
| 727,816 | 5/1903 | Lyon | 96/116 |
| 2,598,732 | 6/1952 | Walkup | 96/45 X |
| 3,249,437 | 5/1966 | Eekhout | 96/116 |
| 3,424,525 | 1/1969 | Towers et al. | 355/48 X |
| 3,905,822 | 9/1975 | Marks | 96/45 X |
| 3,914,040 | 10/1975 | McVeigh | 355/3 R |
| 4,027,962 | 6/1977 | Mailloux | 355/4 |

*Primary Examiner*—Richard L. Moses
*Attorney, Agent, or Firm*—J. J. Ralabate; C. A. Green; H. Fleischer

[57] ABSTRACT

A half-tone screen in which a substantially transparent substrate has a plurality of opaque regions disposed thereon. The opaque regions are arranged in at least a high frequency repetitive pattern and a low frequency repetitive pattern. This type of screen may be employed to modulate the light image of a color transparency being reproduced by an electrophotographic printing machine.

14 Claims, 3 Drawing Figures

MULTI-FREQUENCY SCREEN

BACKGROUND OF THE INVENTION

This invention relates generally to an electrophotographic printing machine, and more particularly concerns a multi-frequency screen for modulating a light image of a color transparency being reproduced by an electrophotographic printing machine.

In the process of electrophotographic printing, a photoconductive member is charged to a substantially uniform level. A light image of the original document irradiates the charged photoconductive member dissipating selectively the charge thereon in accordance with the intensity thereof. In this manner, an electrostatic latent image is recorded on the photoconductive member corresponding to the original document being reproduced. Generally, heat settable particles are employed to develop the latent image. These particles are then trasferred from the latent image to a sheet of support material, in image configuration. Heat is then applied to the particles to permanently affix them to the sheet of support material.

Multi-color electrophotographic printing is substantially the same as the process heretofore discussed. However, a plurality of cycles are employed. Each cycle reproduces a different color contained in the original document. This requires that the light image of the original document be filtered to record an electrostatic latent image corresponding to a single color of the original document. These latent images are developed with appropriately colored particles. The particles are then transferred to the sheet of support material, in superimposed registration with one another. In this manner, a multi-layered powder image is formed on the sheet of support material. This multi-layered powder image is permanently affixed to the sheet of support material by the application of heat to produce a permanent color copy of the original document.

Heretofore, it has been difficult to produce copies having subtle variations of tone or color. Thus, the reproduction of color slides having pictorial quality has not been very feasible. In order to overcome this problem, a half-tone screen is frequently interposed into the optical light path. This screen produces tone gradations by forming half-tone dots or lines of varying size. In the highlight zones, the dots are small increasing in size throughout the intermediate shades until they merge together in the shadow regions. At the highlight end of the tonal scale there will be complete whiteness, while the shadow end will have nearly solid blackness. Numerous patents describe the concept of screening. Exemplary of these patents are U.S. Pat. Nos. 2,598,732; 3,535,036; 3,121,010; 3,193,381; 3,776,633; and 3,809,555.

In addition to the generally available commercial copying machines arranged to reproduce opaque copies, many types of machines are in wide use for reproducing microfilm. For example, U.S. Pat. Nos. 3,424,525; 3,542,468; and 3,547,533 describe typical microfilm copying machines. However, in microfilm copying machines, it has been extremely difficult to form copies of transparencies wherein the copy will have pictorial quality.

With the advent of multi-color electrophotographic printing, it has become highly desirable to be capable of reproducing color transparencies, such as 35mm slides. However, it is required that the copy produced therefrom be of pictorial quality. This necessitates the use of a half-tone screen to achieve this result. One type of system employing half-tone screen for the reproduction of color transparencies is described in co-pending U.S. application, Ser. No. 540,617 now U.S. Pat. No. 4,027,962 filed in 1975. As described therein, a light image of the color transparency is projected through a half-tone screen having 85 dots per inch. However, this may range from about 65 to 300 dots per inch. In this type of a screen, the dot frequency appears to be fixed and only one dot frequency is employed. It has been found that a screen of this type may cause significant light loss due to the relatively high minimum density. In addition, this screen is expensive because of the accurate exposure and development required to produce the required gray scale. In order to improve the foregoing situation, multiple dot line frequencies on a common screen have been employed. Screens of this type show an efficiency gain of more than 100% over a single frequency screen. Moreover, the cost of materials and the control required to make a screen of this type is significantly less than that required to construct a conventional screen.

Heretofore, half-tone cross-lined contact screens have been used to convert an image having a variety of continuous tones into differently sized dots for the preparation of half-tone printing plates. For example, U.S. Pat. No. 3,275,445 issued to Middlemiss in 1966 discloses a screen having a continuous tone medium with portions thereof varying in density. This patent describes the formation of the screen by successive exposure through two cross-lined screens into a continuous tone material. U.S. Pat. No. 2,095,015 issued to Von-Kujawa in 1937 describes a clear-opaque pattern which is employed through a softly focused lens to manufacture a half-tone screen. The final screen is also produced upon a continuous tone material and has a continuous density range. Similarly, U.S. Pat. No. 3,258,341 issued to Riemerschmid et al. in 1966 and U.S. Pat. No. 3,095,909 issued to Bennett in 1937 teach the use of continuous tone material requiring variable density in their half-tone screens.

It is a primary object of the present invention to improve the screen employed in the optical system of an electrophotographic printing machine reproducing a color transparency.

SUMMARY OF THE INVENTION

Briefly stated, and in accordance with the present invention, there is provided half-tone screen for modulating the light image of a color transparency being reproduced in an electrophotographic printing machine.

Pursuant to the features of the present invention, the screen includes a substantially transparent substrate having a plurality of opaque regions disposed thereon. The opaque regions are arranged in at least a high frequency repetitive pattern and a low frequency repetitive pattern.

As used in the electrographic printing machine, the screen is located in the optical light path spaced from the photoconductive member. The photoconductive member is charged and a light image of the color transparency is projected therethrough. In this manner, the screen modulates the light image irradiating the charged portion of the photoconductive member. The charge on the photoconductive member is selectively discharged recording thereon a modulated electrostatic latent image.

BRIEF DESCRIPTION OF THE DRAWINGS

Other objects and advantages of the present invention will become apparent upon reading the following detailed description and upon reference to the drawings, in which.

Figure 1:
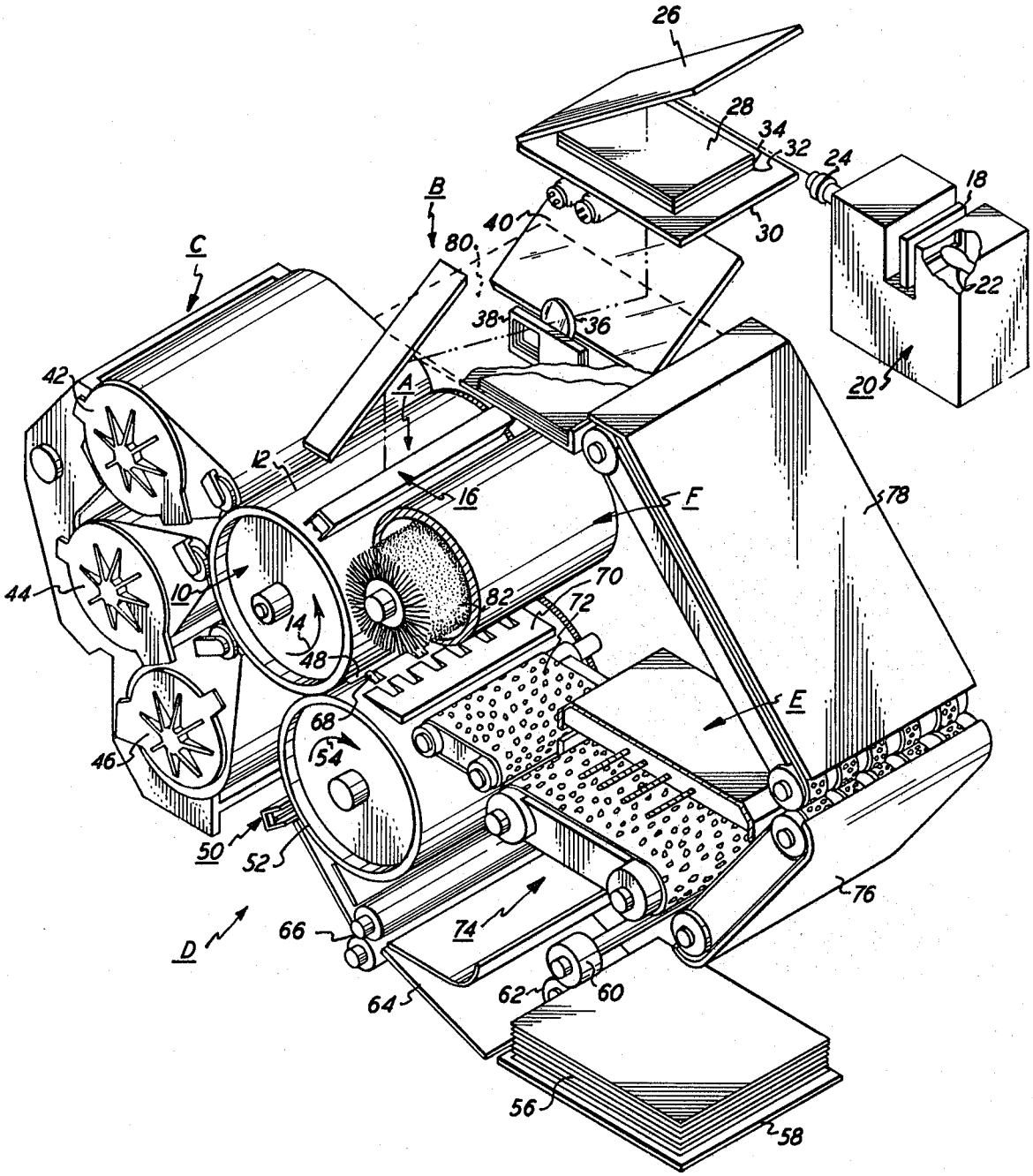
FIG. 1 is a schematic perspective view of an electrographic printing machine incorporating the features of the present invention therein.

While the present invention will hereinafter be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine incorporating the features of the present invention therein, continued reference is had to the drawings. In the drawings, like reference numerals have been used throughout to designate identical elements. Although the color electrophotographic printing machine of the present invention is particularly well adapted for producing color copies from color transparencies or microfilm, it should be evident from the following discussion that it is equally well suited for use in a wide variety of applications such as producing color copies from opaque originals, as well as black and white copies from black and white transparencies or from black and white opaque originals, and is not necessarily limited to the particular embodiment shown herein.

For purposes of the present disclosure, each of the processing stations employed in the electrophotographic printing machine of FIG. 1 will be briefly described hereinafter.

As illustrated in FIG. 1, the electrophotographic printing machine employs a photoconductive member having a drum 10 mounted rotatably within the machine frame. Photoconductive surface 12 is secured to drum 10 and entrained thereabout. Preferably, photoconductive surface 12 is made from a suitable panchromatic selenium alloy such as is described in U.S. Pat. No. 3,655,377 issued to Sechak in 1972.

Drum 10 rotates, in the direction of arrow 14, and at a substantially constant angular velocity. In this manner, photoconductive surface 12 passes through a series of processing stations disposed about the periphery thereof. A timing disc operating in conjunction with the rotation of drum 10, activates each of the processing stations at the appropriate time.

First, drum 10 is sensitized. This is achieved by rotating a portion of photoconductive surface 12 through charging station A. At charging station A, a corona generating device, indicated generally by the reference numeral 16, charges at least a portion of photoconductive surface 12 to a relatively high substantially uniform level. A suitable corona generating device is described in U.S. Pat. No. 3,875,407 issued to Hayne in 1975.

After photoconductive surface 12 is charged to a substantially uniform potential, drum 10 rotates the charged portion thereof to exposure station B. At exposure station B, a color filtered light image of color transparency 18 exemplified by a 34mm slide, is projected onto the charged portion of photoconductive surface 12. Color transparency 18 is positioned in slide projector 20. Slide projector 20 inclues a light source 22 adapted to illuminate a transparency 18. In addition, slide projector 20 includes a lens 24 having an adjustable focus to produce an enlarged or magnified image of color transparency 18. The enlarged image of color transparency 18 is transmitted to mirror 26. Mirror 26 reflects the enlarged image in a downward direction through Fresnel lens 28. Interposed between Fresnel lens 28 and transparent platen 30 is an optional opaque sheet 32 having an aperture therein, i.e., a picture frame or informational frame, which may be considered a composition frame. Composition frame 32 defines an opaque border extending outwardly from the periphery of the color transparency image passing through platen 30. Frame 32 may have indicia inscribed thereon. A screen 34 may be disposed beneath Fresnel lens 28, i.e., interposed between Fresnel lens 28 and composition frame 32. Screen 34 includes a high frequency screening pattern and a low frequency screening pattern thereon. In this manner, screen 34 modulates the color transparency image forming a half tone of light image. The detailed structural configuration of screen 34 will be described hereinafter with reference to FIGS. 3 through 5, inclusive.

The scanning system includes amoving lens system designated generally by the reference numeral 36, and a color filter mechanism shown generally at 38. Lamps 40 move in a timed relationship with lens 36 to scan and illuminate successive incremental areas of composition frame 32 disposed on platen 30. In this manner, a combined image of the enlarged color transparency and composition frame is formed.

Size for size copies of the transparency rather than enlarged copies thereof may be optionally formed. In this mode, projector 20 serves as an additional illumination source. Transparency 18 is placed on platen 30 with composition frame 32 still positioned over a portion thereof. The aperture in frame 32 is designed to extend in an outwardly direction from the borders of transparency 18. Moreover, a plurality of transparencies may be positioned on platen 30 with composition frame 32 having a plurality of apertures therein adapted to be positioned over each transparency. Hence, the resultant copy will comprise one or a plurality of size for size transparencies. The details of exposure station B will be described hereinafter with reference to FIG. 2.

After the electrostatic latent image is recorded on photoconductive surface 12, drum 10 rotates to development station C. At development station C, three individual developer units, generally indicated by the reference numerals 42, 44 and 46, respectively, are arranged to render visible the electrostatic latent image recorded on photoconductive surface 12. Preferably, each of the developer units is of a type generally referred to in the art as a "magnetic brush developer unit". Typical magnetic brush developer units employ a magnetizable developer mix having carrier granules and heat settable toner particles. In operation, the developer mix is brought through a directional flux field to form a chainlike array of fibers. These fibers extend in an outwardly direction from the development unit and contact the electrostatic latent image recorded on photoconductive surface 12. Toner particles are attracted from the carrier granules to the latent image. Each of the developer units contain appropriately colored toner particles. Thus, a green filtered light image is developed with magenta toner particles, a red filtered light image with cyan toner particles, and a blue filtered light image with yellow toner particles. A development system suitable for accomplishing the foregoing is described in U.S. Pat. No. 3,854,449 issued to Davidson in 1974.

After the single color electrostatic latent image is developed, drum 10 rotates to transfer station D. At transfer station D, the toner powder image adhering electrostatically to photoconductive surface 12 is transferred to a sheet of support material 48. Support material 48 may be a sheet of paper of plastic material, amongst others. Transfer station B includes a corona generating device 50 and a transfer roll 52. Corona generator 50 is excited with an alternating current and arranged to precondition the toner powder image adhering electrostatically to photoconductive surface 12. In this manner, the preconditioned toner powder image is readily transferred from the electrostatic latent image to support material 48 secured releasably on transfer roll 52. Transfer roll 52 recirculates support material 48 and is electrically biased to a potential of sufficient magnitude and polarity to attract electrostatically the pre-conditioned toner particles from the latent image thereto. Arrow 54 indicates the direction of rotation of transfer roll 52. Drum 10 and transfer roll 52 rotate at the same angular velocity. In this manner, a plurality of toner powder images may be deposited on support material 48 in superimposed registration with one another. U.S. Pat. No. 3,838,918 issued to Fisher in 1974 discloses a suitable transfer system of this type.

Turning now to the sheet feeding apparatus, support material 48 is advanced from a stack 56 mounted on a tray 58. Feed roll 60, in operative communication with retard roller 62, advances and separates the uppermost sheet from stack 56. The advancing sheet moves into chute 64 which guides it into the nip between register rolls 66. Register rolls 66 align and forward the sheet to gripper fingers 68 which are mounted movably on transfer roll 52. Gripper fingers 68 attach support material 48 releasably on transfer roll 52. After the requisite number of toner powder images have been transferred to support material 48, gripper fingers 68 release support material 48 and space it from transfer roll 52. As transfer roll 52 continues to rotate in the direction of arrow 54, stripper bar 70 is interposed therebetween. In this way, support material 48 passes over stripper bar 70 onto endless belt conveyor 72. Endless belt conveyor 72 advances support material 48 to fixing station E.

At fixing station E, a fuser, indicated generally by the reference numeral 74 generates sufficient heat to permanently affix the multi-layered powder images to support material 48. A suitable fusing device is described in U.S. Pat. No. 3,781,516 issued to Tsilibes et al. in 1973. After the fixing process is completed, support material 48 is advanced by endless belt conveyors 76 and 78 to catch tray 80. At catch tray 80, the machine operator removes the completed color copy from the printing machine. Invariably, residual toner particles remain adhering to photoconductive surface 12 after the transfer process. These residual toner particles are removed from photoconductive surface 12 at cleaning station F. Cleaning station F includes a corona generating device (not shown) for neutralizing the electrostatic charge remaining on the residual toner particles and photoconductive surface 12. The neutralized toner particles are then cleaned from photoconductive surface 12 by a rotatably mounted fibrous brush 82 in contact therewith. A suitable brush cleaning device is described in U.S. Pat. No. 3,590,412 issued to Gerbasi in 1971.

It is believed that the foregoing description is sufficient for purposes of the present application to depict the general operation of an exemplary color electrophotographic printing machine incorporating the features of the present invention therein.

Figure 2:
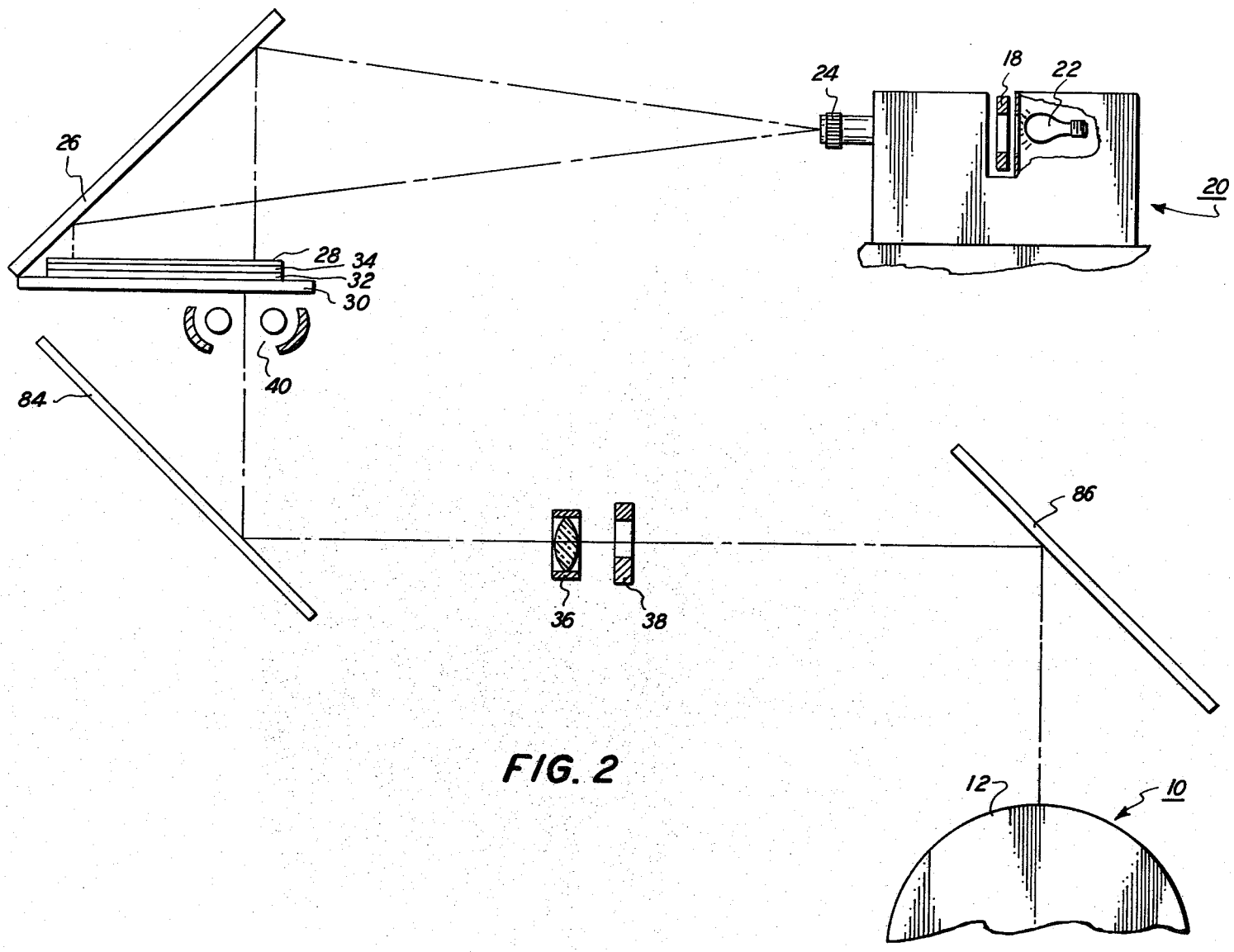
FIG. 2 is a schematic illustration of the optical system employed in the FIG. 1 printing machine.

Referring now to FIG. 2, there is shown, in greater detail, exposure station B. As depicted therein, exposure station B includes projector 20 having lamps 22 illuminating color transparency 18. Lens 24 of projector 20 projects an enlarged image of color transparency 18 onto mirror 26. Mirror 26 reflects the image of color transparency 18 through Fresnel lens 28, screen 34, composition frame 32, and tansparent platen 30. Lamps 40 are arranged to traverse platen 30 illuminating incremental widths of composition frame 32. A carriage, driven by a cable pulley system from a drive motor rotating drum 10, supports lamp 40. As the carriage traverses platen 30, another cable system moves lens 36 and filter 38 at a correlated speed therewith. Filter assembly 38 is mounted on a suitable bracket extending from lens 36 to move in conjunction therewith. Thus, lamps 40, lens 36 and filter 38 produce a flowing light image from the light image of the color transparency as well as that of the composition frame.

Preferably, projector 20 is a Kodak Carousel 750/H projector having an F/2.8 Ektanar C projection lens with light source 22 being a tungsten lamp. Tungsten lamp 22 illuminates color transparency 18 and lens 24 produces an enlarged image thereof.

Preferably, Fresnel lens 28 comprises small, recurring light deflecting elements that will, as an entire unit, achieve a uniform distribution of light over a predetermined area. The gratings or grooves therein are preferably about 200 or more per inch. Fresnel lens 28 converges the diverging light rays from lens 24 transmitted by mirror 26 in a downwardly direction. Thus the light rays passing through platen 30 are substantially parallel. Other suitable field lens may also be employed in lieu of the Fresnel lens heretofore described. U.S. Pat. No. 3,424,525 issued to Towers et al. in 1969 describes a suitable type of Fresnel lens.

The light image of the color transparency passes through screen 34. Screen 34 modulates the light image forming a half tone light image thereof. Hence, a modulated light image is combined with the image of composition frame 32. This combined light image is directed by mirror 86 onto the charged portion of photoconductive surface 12. In this manner, photoconductive surface 12 is selectively discharged recording a modulated electrostatic latent image thereon. U.S. Pat. No. 3,062,108 issued to Mayo in 1962 describes a suitable optical systemm drive mechanism.

Preferably, lens 36 is a six-element split dagor type of lens having front and back compound lens components with a centrally located diaphragm therebetween. Lens 36 forms a high quality image withh a field angle of about 31° and a speed ranging from F/4.5 to about F/8.5 at a 1:1 magnification. In addition, lens 36 is designed to minimize the effect of secondary color in the image plane. The front lens component has three lens elements including, in the following order; a first lens element of positive power, a second lens element of negative power cemented to the first lens element, and a third lens element of positive power disposed between the second lens element and the diaphragm. The back component also has three similar lens elements positioned so that lens 36 is symmetrical. Specifically, the first lens element in the front component is a double convex lens, the second element is a double concave lens, and a third element a convex-concave lens element. For greater details regarding lens 36, reference is made to U.S. Pat. No. 3,592,531 issued to McCrobie in 1971. As heretofore indicated, screen 34 includes thereon a low frequency screen pattern and a high frequency screen pattern. Thus, the modulated light image has two frequencies, i.e., the low frequency and high frequency components of the screening pattern. However, lens 37 is adapted to transmit therethrough only the low frequency pattern. Hence, the charged portion of photoconductive surface 12 is irradiated only by the low frequency image component.

With continued reference to FIG. 2, filter 38 includes a housing which is mounted on lens 36 by a suitable bracket and moves with lens 36 during scanning as a single unit. The housing of filter 38 includes a window which is positioned relative to lens 36 enabling the light rays of the combined image, i.e., that of the composition frame and color transparency, to pass therethrough. Each of these tracks is adapted to carry a filter permitting movement thereof from an inoperative position to an operative position. In the operative position, the filter is interposed into the window of the housing permitting light rays to pass therethrough. Individual filters are made from any suitable filter material such as coated glass. Preferably, three filters are employed in the electrophotographic printing machine, i.e., a red filter, a blue filter and a green filter. A detailed description of the filter mechanism is found in U.S. Pat. No. 3,775,006 issued to Hartman et al. in 1973.

Figure 3:
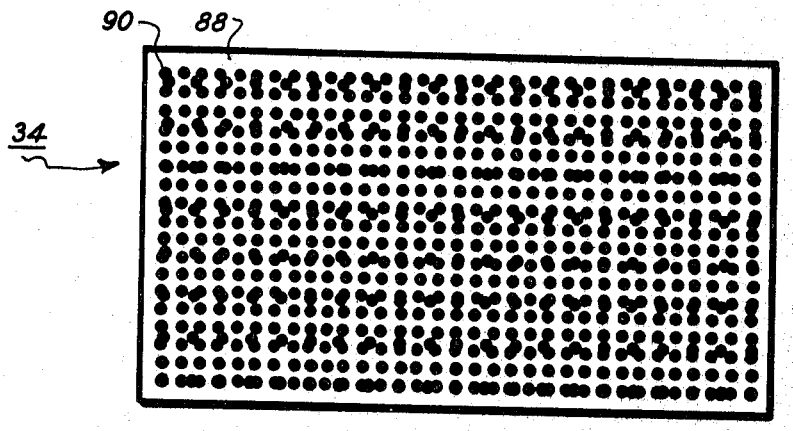
FIG. 3 is an elevational view depicting the screen utilized in the FIG. 2 optical system.

Turning now to FIG. 3, there is shown an elevational view of one embodiment of screen 34. As depicted thereat, screen 34 includes a clear transparent substrate 88 having a plurality of spaced opaque regions 90 thereon. Opaque regions 90 comprise a plurality of dots. The opaque dots 90 disposed on transparent substrate 88 have a high frequency and low frequency component. Preferably, the low frequency component is 85 dots per inch and the high frequency component is 300 dots per inch. Thus, it is seen that the pattern of dots is such that one dot having a maximum area will be surrounded by a plurality of other dots having a lesser area. This is due to the fact that when the dots having a frequency of 300 dots per inch are superimposed with the dots having a frequency of 85 dots per inch, substantial coincidence occurs at certain points. At the points of coincidence, a maximum area dot is produced. However, inasmuch as there are many more dots having non-coincidence than having coincidence, a maximum area dot is surrounded by a plurality of lesser area dots.

Preferably, transparent substrate 88 is made from a suitable plastic or glass. Opaque regions 90 are printed on the transparent substrate by a suitable chemical, photographic or printing techniques.

While the opaque regions have heretofore been described as being dots, it will be evident to one skilled in the art that a line screen may be used in lieu thereof. Thus, a multiple frequency line screen would have 300 lines per inch at the high frequency and an 85 lines per inch at the low frequency end. In the regions of substantial coincidence, a maximum area line would be produced while the regions of non-coincidence would have minimum area line. In this type of pattern, a maximum area line would be surrounded by a plurality of minimum area lines.

By way of example, the screen depicted in FIG. 3, may be produced by employing a tungsten point light source. Light rays from the light source pass are transmitted through an 85 line or dot screen. The half tone light image transmitted through the 85 line or dot screen is then transmitted through a 300 line or dot screen onto a high contrast graphic arts film. After development, a screen having the desired characteristics of FIG. 3 is produced. As heretofore noted, the screen comprises high and low frequency screening components.

In summary, the multi-frequency screen heretofore described has significantly higher efficiency and reduced cost. This multi-frequency screen may be readily employed in a color electrophotographic printing maachine arranged to reproduce color transparencies as enlarged or size for size color opaque copies.

Thus, it is apparent that there has been provided, in accordance with the present invention, a multi-frequency screen for use in electrophotographic printing that satisfies the objects, aims and advantages hereinbefore set forth. While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrophotographic printing machine for reproducing a color transparency, including:

a photoconductive member;

means for charging at least a portion of said photoconductive member to a substantially uniform potential;

a receiving member spaced from said photoconductive member;

a screen member mounted on said receiving member, said screen member comprising a low frequency repetitive pattern of opaque regions and a high frequency repetitive pattern of opaque regions extending across said screen member and being superimposed over one another with each opaque region being substantially identical to one another; and means for projecting a light image of the color transparency through said screen member onto the charged portion of said photoconductive member discharging selectively the charge to record thereon a modulated electrostatic latent image.

2. A printing machine as recited in claim 1, further including:

a composition frame disposed on said receiving member; and means for exposing the charged portion of said photoconductive member to a light image of said composition frame recording thereon a combined electrostatic latent image comprising the electrostatic latent image of the color transparency and the electrostatic latent image of said composition frame.

3. A printing machine as recited in claim 2, wherein said exposing means includes:

a light source arranged to illuminate said composition frame on said receiving member; and a lens positioned to receive the light rays transmitted from said composition frame and the light image of the color transparency, said lens transmitting the low frequency components of the light image passing through said screen member and not transmitting the high frequency component therethrough.

4. A printing machine as recited in claim 1, wherein said screen member includes a substantially transparent substrate having the opaque regions disposed thereon.

5. A printing machine as recited in claim 4, wherein the opque regions include spaced dots.

6. A printing machine as recited in claim 5, wherein the dots include a pattern of first dots of a maximum area and a pattern of second dots of a lesser area disposed thereabout.

7. A printing machine as recited in claim 5, wherein said dots include a low frequency repetitive pattern of about 85 dots per inch and a high frequency repetitive pattern of about 300 dots per inch.

8. A printing machine as recited in claim 1, further including means for filtering the light image to form a single color light image which irradiates the charged portion of said photoconductive member to record thereon a modulated single color electrostatic latent image.

9. A printing machine as recited in claim 1, wherein said receiving member includes:

a substantially transparent platen member having said screen member disposed thereon; and a field lens interposed between said platen member and said screen member.

10. A printing machine as recited in claim 9, wherein said field lens preferably includes about 200 gratings per inch.

11. A half-tone screen, including:

a substantially transparent substrate; and a plurality of opaque regions disposed on said substrate, said opaque regions being arranged in a high frequency repetitive pattern and a low frequency repetitive pattern extending across said substrate and being superimposed over one another with each opaque region being substantially identical to one another.

12. A screen as recited in claim 11, wherein said opaque regions include spaced dots.

13. A screen as recited in claim 12, wherein the dots include a pattern of first dots of maximum area and a pattern of second dots of a lesser area disposed thereabout.

14. A screen as recited in claim 12, wherein said dots include a low frequency repetitive pattern of about 85 dots per inch and a high frequency repetitive pattern of about 300 dots per inch.

* * * * *